US009997017B2

(12) United States Patent
Czubak

(10) Patent No.: US 9,997,017 B2
(45) Date of Patent: Jun. 12, 2018

(54) METHOD AND SYSTEM FOR RETROFITTING EXISTING GAMING MACHINES TO TRACK GAMING ACTIVITY

(71) Applicant: Roman Czubak, Traiskirchen (AT)

(72) Inventor: Roman Czubak, Traiskirchen (AT)

(73) Assignee: Novomatic AG, Gumpoldskirchen (AT)

( * ) Notice: Subject to any disclaimer, the term of this patent is extended or adjusted under 35 U.S.C. 154(b) by 223 days.

(21) Appl. No.: 14/613,885

(22) Filed: Feb. 4, 2015

(65) Prior Publication Data

US 2015/0154825 A1 Jun. 4, 2015

Related U.S. Application Data

(63) Continuation of application No. 13/590,638, filed on Aug. 21, 2012, now abandoned.

(51) Int. Cl.
*A63F 9/24* (2006.01)
*G07F 17/32* (2006.01)

(52) U.S. Cl.
CPC ..... *G07F 17/3237* (2013.01); *G07F 17/3239* (2013.01); *G07F 17/3244* (2013.01); *G07F 17/3251* (2013.01); *G07F 17/3255* (2013.01)

(58) Field of Classification Search
None
See application file for complete search history.

(56) References Cited

U.S. PATENT DOCUMENTS 5,679,945 A * 10/1997 Renner ..... G06K 7/0008 235/441
6,852,029 B2 * 2/2005 Baltz ..... G07F 17/32 463/25
6,905,411 B2 * 6/2005 Nguyen ..... G07C 9/00031 463/25
7,572,183 B2 * 8/2009 Olivas ..... G07F 17/34 463/10
8,602,874 B2 * 12/2013 Rowe ..... G06Q 20/02 463/25
2002/0034299 A1 * 3/2002 Charrin ..... G07F 17/32 380/251
2003/0171145 A1 * 9/2003 Rowe ..... G06Q 20/02 463/25
2004/0043814 A1 * 3/2004 Angell ..... G07F 17/0014 463/25
2005/0124407 A1 * 6/2005 Rowe ..... G07F 17/32 463/25
2008/0248865 A1 * 10/2008 Tedesco ..... G07F 17/3248 463/25
2009/0239667 A1 * 9/2009 Rowe ..... G07F 17/32 463/42
2010/0069145 A1 * 3/2010 Velu ..... G07F 17/32 463/25

* cited by examiner

*Primary Examiner* — Lawrence Galka
(74) *Attorney, Agent, or Firm* — Kevin H. Fortin

(57) ABSTRACT

A gaming machine system and method for retrofitting the gaming machines to track activity of users. The gaming machine system includes gaming machines in communication with a server with a database. The gaming machines each include a cash ticket reader and a cash ticket printer. The gaming machines retrofitted with software that adapts the cash ticket reader and the cash ticket printer to additionally read and print tracking tickets. The cash tickets include a cash value and the tracking tickets include a code representative of a user.

19 Claims, 4 Drawing Sheets

41

| 31,40 | 42 | 43 | 44 |
|---|---|---|---|
| 151 | 15 | 17:27 | - € 30 |
| | 17 | 19:30 | + € 5 |
| 152 | 7 | 18:24 | - € 100 |
| | 12 | 19:17 | + € 250 |
| | 17 | 20:30 | - € 30 |
| 153 | 12 | 18:15 | - € 700 |
| 154 | 19 | 20:02 | - € 50 |
| | 13 | 22:05 | + € 10 |

13

11

Fig. 5

METHOD AND SYSTEM FOR RETROFITTING EXISTING GAMING MACHINES TO TRACK GAMING ACTIVITY

CROSS-REFERENCE TO RELATED APPLICATIONS

This patent application is a continuation of co-pending U.S. patent application Ser. No. 13/590,638, filed 21 Aug. 2012.

FIELD OF THE INVENTION

The invention relates to a hardware and methods for tracking the activity of a gaming machine users.

BACKGROUND

Gaming machines, including card gaming machines take a myriad of forms. Gaming machines are designed to offer enjoyment, entertainment and pleasure. Some gaming machines offer payouts, which add to the enjoyment of the game.

Some gaming machine platforms include systems for tracking the activity of the user on gaming machines in an effort to continually improve user gaming experience. Other gaming machine platforms don't offer activity tracking as a feature, although many prefer to track their activity to become eligible additional rewards, bonuses and entertainment.

Card games played on gaming machines, and other games, can make use of bonus cards or bonus chips, which are handed to the user. When the user plays a game on a gaming machine he or she provides the chip or bonus card to the gaming machine, so that the gaming machine identifies the identity of the user and tracks the activity of the user. A chip or bonus card may take the form of a device having a smart card integrated circuit, or any electronically or magnetically readable device, or simply a data code on a paper ticket.

Methods for tracking the activity of the user as known from the state of the art typically require gaming machines or servers which are prepared to read and dispense the afore-mentioned bonus cards or chips. For this reason it is cumbersome and expensive to upgrade an existing gaming system, so as to make tracking of the activity of the user available. It is especially difficult to extend an existing gaming machine with a bonus card- or chip reading-device, because gaming machines typically have a user interface that is defined by hardware components. Modification to this user interface, and other similar ones, would require a hardware upgrades that would be economically inefficient, or infeasible.

Users of gaming machines could benefit by improving their gaming experience from easy upgrades and modifications to existing gaming machines. Ideally, any upgrade would improve tracking of activity of a user of a gaming machine within a network of gaming machines, among other possibilities. It is also desired to have improved enjoyment and game play for users by applying simple upgrades to existing machines.

SUMMARY OF THE INVENTION

The gaming machine is of the present invention is pre-configured with a ticket printer and reader for printing and reading cash tickets, which function as cash. Further, the gaming machine is adapted to employ the ticket printer and reader to also print and read tracking tickets, respectively. This adaptation enables most gaming machines that print only cash tickets to be upgraded to handle user tracking features that improve gaming experience, among other things.

The invention includes a method for tracking the activity of a user of a gaming machine that is connected to a server with a database. The method is employed by a gaming machine that is pre-equipped with a ticket printer and a ticket reader for printing and reading cash tickets, respectively. Ideally a software program is introduced and stored on the gaming machine, or on a network server, to enable the gaming machine to utilize user-tracking features. The invention includes the software program, which may include firmware.

According to the inventive method, an account number is assigned to a user and a tracking ticket is created for said user. In one embodiment, the tracking ticket includes a respective code for the account number. The tracking ticket is printed and provided to the user. A record is created and stored in the database and the account number being assigned to the record as a key value. Accordingly, both a tracking ticket and a cash ticket are employed by various embodiments of the present invention. The tracking ticket and the cash ticket are printable by a single ticket printer and readable by a single ticket reader.

Before a game is started, a connection to the server is established and the tracking ticket is read by the gaming machine. At the end of the game the tracking ticket or a further tracking ticket, is provided to the user. A code encoding the account number is printed on this tracking ticket. Before or after or during the game a data packet comprising the account number of the ticket as well as further gaming information, preferably an identification number of the gaming machine, a time stamp, and information is pertaining to the results of the game. This further gaming information is also provided to the server and stored to the record having the same account number as the packet. Storing the further gaming information enables gaming system designers to have freedom to design additional bonuses, bonus games, features and payouts based on the further gaming information.

A software update can adapt various gaming machines to employ the methods of the present invention. It is not necessary to add hardware components to an existing gaming machine, such as ticket reader devices, because existing gaming machines typically include a ticket reader and ticket writer in order to process cash tickets. However, a network interface may be introduced to a non-networked gaming machine according to one embodiment of the invention.

Accordingly, one significant benefit of the present invention is to retrofit an existing gaming machine to employ the methods and software of the present invention. Software, as defined herein, includes updatable firmware and programmable code stored on a hard drive, solid-state memory, or other media. Software may be updated en masse via a network server in communication with the gaming machines, or by updating each machine.

In one embodiment, the tickets have a defined expiration date. In particular an account number may be invalidated, terminated, or deleted after a predefined time limit, or at the defined expiration date. Preferably a time limit between one and ten days, as from the creation of the record or as from the time, when last data were stored in the record and assigned to the account number. The time for invalidation for the ticket can thus be pre-determined, or alternatively be determined based on user account information. Invalidation may include deletion of the record.

Most preferably the invention can be carried out on a gaming machine which is already equipped with a cash ticketing system. In this particular case it is provided, that a further cash ticket, on which cash information is printed and encoded, is fed to the gaming machine and read by the gaming machine before the beginning of the game. The cash information is normally altered according to the results of the game. At the end of the game, preferably before printing the tracking ticket, the cash ticket is printed and provided to the user. The tracking ticket and the cash ticket are printed by the ticket printer of the gaming machine and/or are read by the ticket reader of the gaming machine. Accordingly, both a tracking ticket and a cash ticket are employed by various embodiments of the present invention. The tracking ticket and the cash ticket are printable by a single ticket printer and readable by a single ticket reader of the gaming machine.

In order to make use of the tracking information on the activity of the user it can be provided, that before starting the game or during the game the record or parts of the record, whose key equals the account number of the tracking ticket, is or are sent to the gaming machine, wherein the gaming program of the gaming machine is modified according to said record.

In particular the motivation of users can be maintained or even raised with a bonus game or more favourable initialization of the game, which is offered to the user, if a bonus game or a more favourable initialization of the game is offered to the user, if the total number of entries or an aggregation, preferably a sum, of entries of the record, such as the number of previously played games or the gaming time, exceeds a predefined threshold value.

In order to pass on the account number via a ticket, it can be provided, that a code corresponding to the account number is printed on the tracking ticket, and wherein said account number is preferably encrypted before encoding and printing.

In order to reuse a ticket for multiple gaming events it can be provided, that an erasable and re-printable tracking ticket is provided to the user, wherein the ticket is erased after reading by the gaming machine and reprinted before it is provided to the user.

In order to maintain the users privacy while tracking his or her information on an individual and personalized account, it can be provided, that the one or more records exclusively contain the account number and information relating to the games, wherein preferably personal information is prohibited, sometimes by legal requirements, from being stored on said records. This assures privacy for the gaming users.

The system in accordance with the present invention includes a plurality of gaming machines and a gaming machine server that are networked. The gaming server provides a database to store a plurality of records, each record having an account number as a key value.

Each of the gaming machines comprises a gaming processor. Each of the gaming machines comprises a ticket reader and a ticket printer, and a network interface for providing a data connection to the database of the server. The account number is assigned to a user and a tracking ticket is created for said user, wherein on the tracking ticket a respective code for the account number is printed and provided to the user.

The gaming processor generates a data packet comprising the account number of the tracking ticket as well as further gaming information, preferably an identification number of the gaming machine, and/or a time stamp, and/or information pertaining to results of the game. After generating said data packet, the gaming processor sends said data packet to the server and causes the server to store the packet with the record having the same account number as the packet.

Such a gaming system offers the possibility of tracking the activity of the user within the framework of existing system hardware. The gaming system of the invention may be implemented by adapting a system of the state of the art via a software modification. It is therefore not necessary to modify the user interface or design of the gaming machine.

In order to have tickets with a defined expire date, the server comprises an invalidation unit which invalidates records of the database after a predefined time limit, preferably from one to ten days, as from the creation of the record or from the date of the latest record data change.

Most preferably the invention can be carried out on a gaming machine which is already equipped with a cash ticketing system. In this particular case it is provided, that wherein the ticket reader is prepared to read a cash ticket on which cash information is printed and encoded, and wherein before, during or after the game the gaming processor amends the cash information according to the results of the game and forces the ticket printer to print a new cash ticket on which the amended cash information is printed and encoded, so that the ticket and the cash ticket are printed by the same printer and read by the same ticket reader.

In order to make use of the tracking information on the activity of the user it can be provided, that wherein on receiving a query on an account number of a gaming machine, the server provides the record having said account number to the respective gaming machine.

In particular the motivation of users can be maintained or even raised with a bonus game or more favourable initialization of the game, which is offered to the user, if after reading a tracking ticket the gaming processor of a gaming machine sends a query regarding the account number of the ticket to the server and receives the record stored in the database having said account number. The gaming processor compares the total number of entries of the record or an aggregation, preferably a sum, of entries of the record, such as the number of previously played games or the gaming time, with a threshold value and determines, if said predefined threshold value is exceeded. The gaming processor is programmed to offer the user a bonus game or a more favourable initialization of the game, if said threshold is exceeded.

In order to pass on the account number via a ticket, it can be provided, that the gaming processor and/or the ticket printer is programmed to encode, and preferably to encrypt, the account number before printing, and/or wherein the gaming processor and/or the ticket reader is programmed to decode, and preferably to decrypt, the account number printed on the tracking ticket before reading.

In order to reuse a ticket for multiple gaming events it can be provided, that wherein the ticket printer is provided to erase and re-print tickets and provide tickets to the user, the ticket printer erasing and reprinting the tracking ticket after being read by the ticket reader.

In order to maintain the users privacy while tracking his or her information on an individual and personalized account, it can be provided, that one or more records are provided to exclusively contain the account number and information relating to the games, and/or wherein said records do not comprise any personal information on the user.

BRIEF DESCRIPTION OF THE DRAWINGS

Various examples of the invention are explained by reference to the drawings in which:

FIG. 5 shows the content of the database which stores activities of a user.

DETAILED DESCRIPTION

Figure 1:
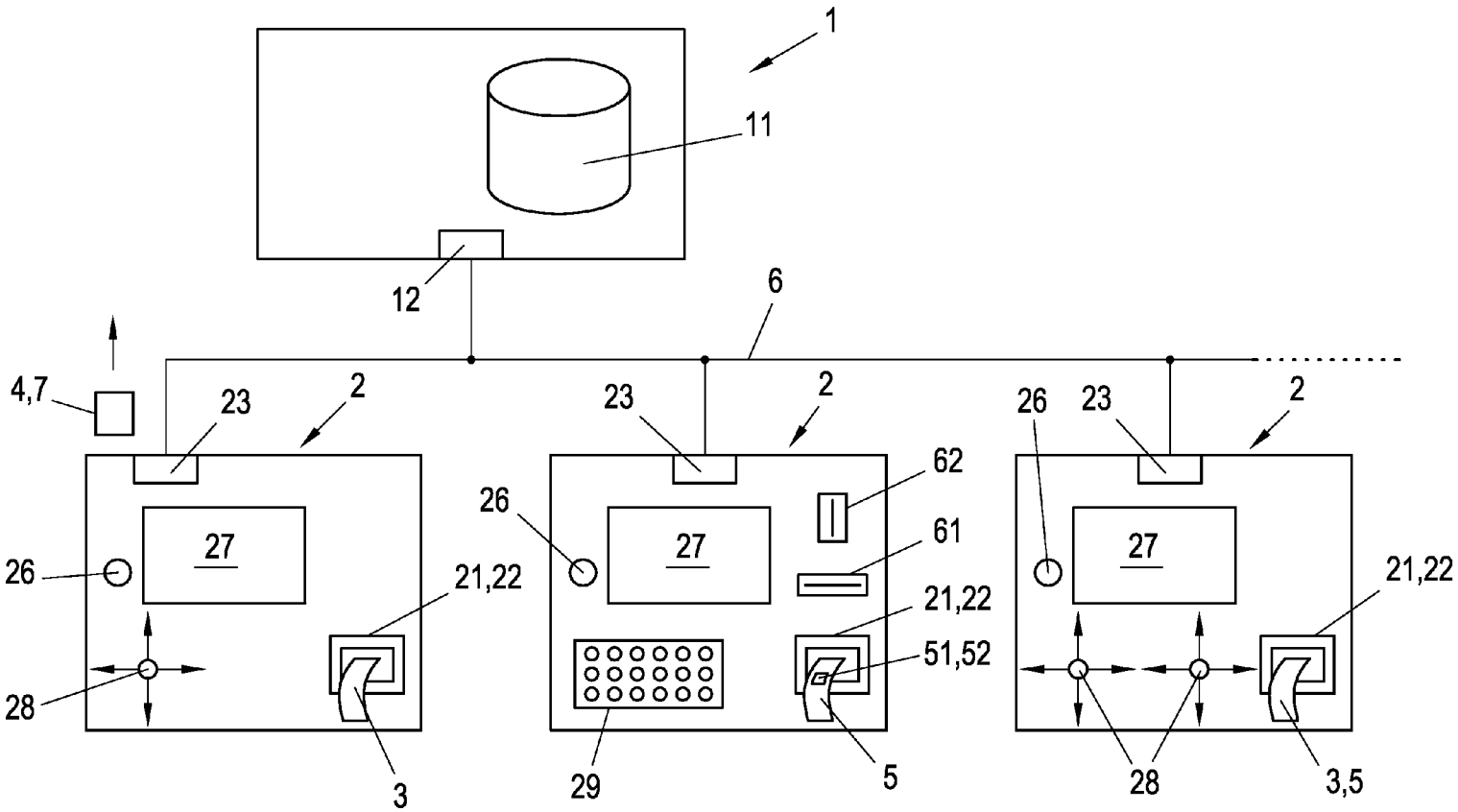
FIG. 1 is a typical system according to the preferred embodiment of a gaming system.

FIG. 1 schematically shows a preferred example of the invention comprising a server 1 with a database 11 and a plurality of gaming machines 2. The server 1 and the gaming machines 2 are connected via a computer network 6, wherein the server 1 comprises a network interface 12 and each of the gaming machines 2 comprises a network interface 23. Each of the gaming machines 2, which are connected to the server 1 via the network 6 comprises a gaming processor 20 (FIG. 2) and gaming peripherals. Each of the gaming machines 2 comprises a display 27 and a cash-out-button 26. The first gaming machine 2, which is shown on the left side of FIG. 1 comprises a single joystick 28, the second gaming machine 2, which is schematically shown in the middle of FIG. 1 comprises a keyboard 29 and the third gaming machine 2, which is shown on the right side of FIG. 1 comprises two joysticks 28. Each of the gaming machines 2 further comprises a ticket reader 21 and a ticket printer 22 for reading and printing tickets 3, 5.

Figure 2:
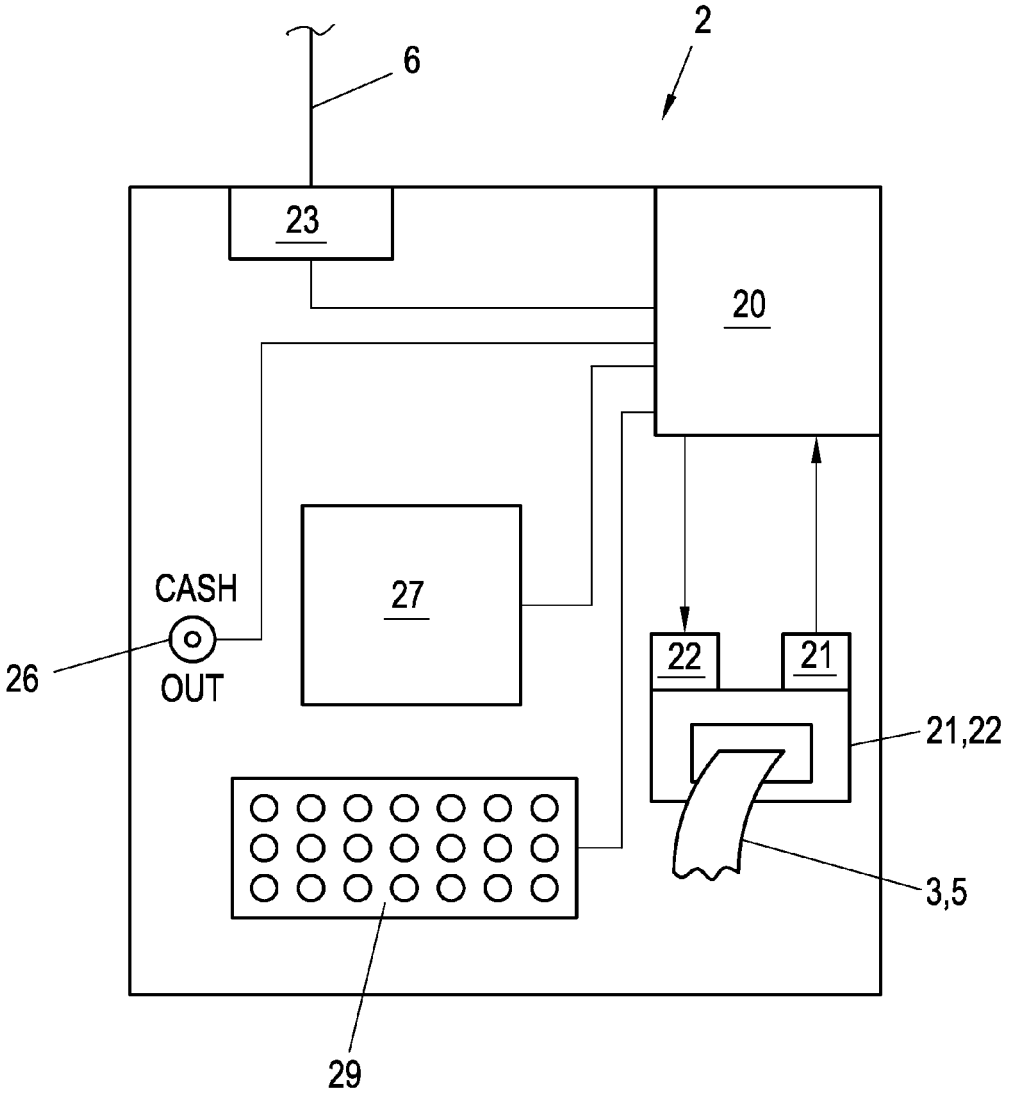
FIG. 2 is a system diagram of a gaming machine.

FIG. 2 schematically shows a gaming machine 2 of FIG. 1 in more detail. The gaming machine 2 shown in FIG. 2 comprises a gaming processor 20, on which a computer program for executing software implementing the respective game on the gaming machine 2 is run. The gaming processor 20 is connected with the peripherals 26, 27, 28, 29 of the gaming machine 2. In this preferred embodiment of a gaming machine 2 the gaming processor 20 is connected to the computer network 6 via network interface 23. The gaming processor 20 is connected to a cash out button 26, a display 27, a keyboard 29 and to a ticket reader 21 and a ticket printer 22. With the ticket reader 21 and the ticket printer 22 of this embodiment of the invention it is possible to read in tickets 3, 5 and print tickets 3, 5 with the same device. This device comprises only one slot, into which a ticket 3, 5 can be inserted and by which a printed ticket 3, 5 can be provided.

Each of the gaming machines 2 of this preferred embodiment of the invention is programmed to read cash tickets 5 via the ticket reader 21 and to print cash tickets 5 via the ticket printer 22. A cash ticket 5 may be handed to the user after the payment of a defined amount of cash. Before the start of the game the cash ticket 5 is inserted into the ticket reader 21. If the amount of cash stored in the cash information 51 is sufficient, the gaming processor 20 starts the game. After the game the cash information 51 stored on the cash ticket 5 is changed according to the results of the game. If for example the user wins a game the amount of cash, which is stored on the cash ticket 5 is increased. If however the user loses the game a certain amount of the cash is subtracted from the initial cash information 51. At the end of the game a cash ticket 5 is printed and provided to the user, wherein the ticket printer 22 prints a new cash ticket 5 on which the changed cash information 51 is printed.

In order to be able to track the activity of a user of the gaming machine 2 each of the gaming machines 2 is connected to the server 1. The server 1 comprises a database 11, whose contents are shown in FIG. 5. The database 11 provides a respective record 13 for each of the users, wherein each record 13 is uniquely assigned to one of the users of the gaming machine 2. When entering the Casino or before starting to play an account number 31 is assigned to the user. The user is provided with a tracking ticket 3, on which a respective code for the account number 31 is printed. When providing a tracking ticket 3 with an account number 31 to the user a record 13 of the database 11 is created. The account number 31 is assigned to the record 13 as key value. Therefore the respective record 13, which is assigned to the user can be accessed via the account number 31 stored on the tracking ticket 3 of the user. Before the user starts to play on one of the gaming machines 2 the record 13 assigned to the user is empty.

Before starting a game on the gaming machine 2 the user is invited to provide his tracking ticket 3 to the gaming machine 2. The user inserts the tracking ticket 3 into the slot of the ticket reader 21, which reads the information printed on the tracking ticket 3 and determines the account number 31 stored on the tracking ticket 3. After reading the tracking ticket 3 the gaming machine 2 invites the user to provide a cash ticket 5 and to start the game. Optionally, instead of the cash ticket 5, bills and/or coins may be provided via a bill acceptor 61 and/or coin acceptor 62 of the gaming machine 2 to start the game.

Figure 3:
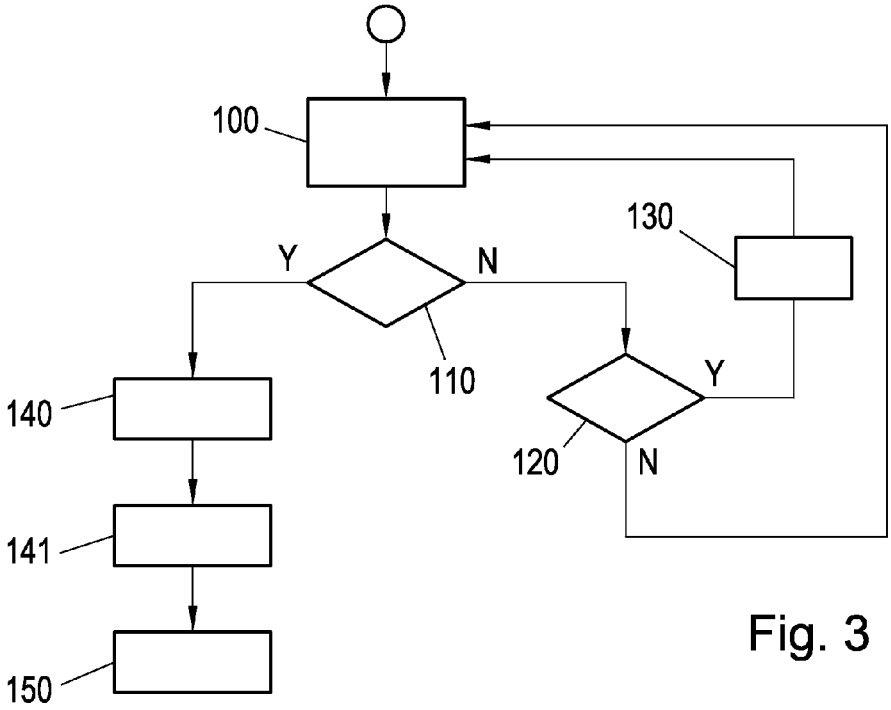
FIG. 3 is a flow chart for initialising a game in accordance with the present invention.

FIG. 3 shows a diagram that illustrates the initialization of a game. In a first step 100 a tracking ticket 3 provided by the user is read by the ticket reader 21. The account number 31 of the tracking ticket 3 is provided to the gaming processor 20. In a second step 110 the gaming processor 20 determines whether the ticket 3, 5 provided by the user is a cash ticket 5 or a tracking ticket 3. If the ticket 3, 5 provided by the user is a cash ticket 5 a game is started (step 140). If, however, the ticket 3, 5 provided by the user is not a cash ticket 5 then the gaming processor 20 determines whether the ticket 3, 5 provided by the user is a tracking ticket 3 (step 120). If the ticket 3, 5 provided by the user is neither a cash ticket 5 nor a tracking ticket 3 the user is invited to provide a further ticket 3, 5. If, however, the ticket 3, 5 provided by the user is a tracking ticket 3, then an initialization step 130 for altering the game is carried out. After this initialization step 130 the game is stored respectively ready for operation.

Figure 4:
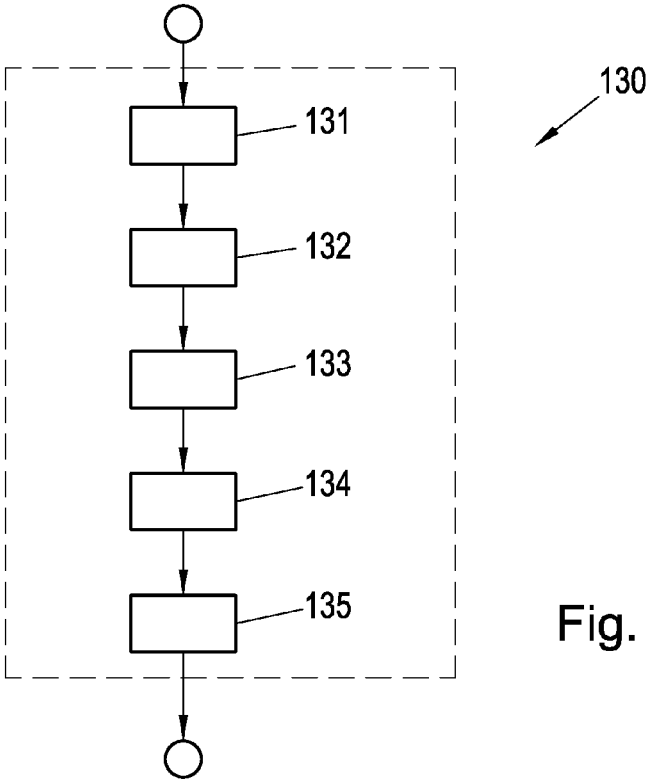
FIG. 4 is a flow chart in accordance with the present invention.

In FIG. 4 a preferred method for the initialization the game in a way more favourable to the user is shown. In a first initialization step 131 the account number 31, which is stored on the tracking ticket 3 is extracted. In a second step 132 the gaming processor 20 sends a query 7 to the server 1 wherein the query 7 comprises the account number 31 stored on the tracking ticket 3. The query 7 is sent by the gaming processor 20 via the network interface 23, the computer network 6 and the network interface 12 of the server 1 to the server 1.

In a further step 133 the server 1 processes the query 7 and identifies the record 13, which is assigned to the account number 31 of the query 7. The server 1 sends the record 13, which is assigned to the account number 31 to the gaming machine 2 via the computer network 6. The gaming processor receives 134 and analyses the record 13.

If the total number of the entries or the number of previously paid games or the gaming time exceeds a predefined threshold value, in this preferred example a threshold value of the games, or 25 minutes, or a loss of a certain amount of money is used, the game provided by the gaming controller 12 is initialized in a more favourable way to the user. In an initialization step 135 of this very example of the invention additional bonus and/or free games are provided to be played by the user.

After amending the game in the initialization step 135, the game is started (step 140). After the end of the game the gaming processor 20 generates a data packet 4, which comprises the account number of the tracking ticket 3 as well as further gaming information, namely an identification number 42 of the gaming machine, a time stamp 43 and information of the results 44 of the game. In this example of the invention the results 44 of the game indicate the amount of cash the user won or lost during the game. The packet 4 is sent to the server 1 as an update request. When the server 1 obtains the data packet 4 the update request stored on that data packet is inserted into the record 13 of the user.

FIG. 5 shows the contents of the database 1, wherein four users are registered to the system and user is provided with a tracking respective ticket 3, each with different account numbers. The first user was provided a ticket on which the account number "151" was stored. At 17:27 the first user lost EUR 30,- on a gaming apparatus with an identification number "15", on at 19:30 the same user won EUR 5,- a gaming apparatus with the identification number "17".

In order to avoid manipulations of the tracking tickets 3 the ticket printer 22 comprises a decryption module, so that an encrypted code corresponding to the account number 31 is printed on the tracking ticket 3. The account number 31 is encrypted before being printed on the tracking ticket 3. The ticket reader 21 comprises a decryption module, which decrypts the code printed on the ticket 3 and determines the account number 31 accordingly. As a separate measure or in addition the operation of the gaming machine 2 may be such that the sequence of receiving the tracking ticket 3 and issuing a new tracking ticket 3 shall be strictly adhered to. That is to say that in case if the account number 31 has been recognized by the gaming system then this account number 31 is locked until the regular new tracking ticket 3 is issued following the end of game play. Optionally, in case if the account number 31 is in the locked state then the gaming system may generate an alarm message, for instance to the system operator, in the case if an identical account number 31 is being recognised within the gaming system.

In this preferred example of the invention the gaming apparatus 2 of the gaming system comprises a ticket printer 22, which is provided to erase and reprint tickets 3, 5. A tracking ticket 3 or cash ticket 5 which is provided to the gaming machine 2 by the user is read by the ticket reader 21 and afterwards erased by the ticket printer 22. After the end of the game the tracking ticket 3 is reprinted and provided to the user.

A further embodiment of the invention uses reprintable tickets 3, 5. Again, a common unit may be used, providing the functionality of the reader 21 and the printer 22. In this regard, reference is made to U.S. Pat. No. 5,854,477, the entire content of which is incorporated herein by reference.

The ticket may be coated with a UV light-sensitive chemical substance such that information can be deleted on the paper by irradiation with ultraviolet light. Alternatively, the paper may be coated with thermally sensitive substances.

Such thermal printing papers have covered on it, for example, in an unactivated state colorless dye, known leuco dye, and a developer. The developer provides an activation of the dyes. The application of heat melts and merges these materials, i.e. their molecules bind together in a chemical reaction. Leuco dyes that have reacted with the developer may produce such as black, blue and other colours. By separating back the coloured leuco dye and developer the colours are "deleted", i.e. so that the displayed information is lost.

Staining and de-colouring are caused by differences in the effect of temperature on the materials. The materials (leuco dyes, developer) melt at higher temperature T1 (for example, 160° C.) and subsequent quenching. Decolouration occurs if the paper is again heated, but to a slightly lower temperature T2. The use of a thermal print head enables the selective use of temperature fields in which colour is desired, for example, to produce text. Use of a heating roller to the entire sheet makes it is possible to delete the text completely. The process of printing and deleting may be carried out several/many times.

Alternatively, it is further possible, as disclosed in JP 2000154345 A (TOSHIBA), the disclosure of which is incorporated herein by reference, to use a deletable printer ink that can be deleted by heat after being printed.

Even if it is possible to connect personal information of the user, such as name, address, credit card number, telephone number etc. with the account number 31 of the user, the preferred example of the invention avoids linking or connecting such a data in order to maintain the privacy of the user. One or more records 13 exclusively contain the account number 31 and information relating to the games. Personal information is prohibited to be stored on those records 13.

After a predefined time limit of for example five days as from its creation a record 13 is invalidated and further gaming information 41, preferably the identification number of the gaming machine 2 a time stamp or information 44 on the results of the game, are prohibited from storage. Alternatively the time limit for storing data to an account may be determined as from the time when the last data were stored to the record 13. A tracking ticket 3 becomes therefore invalid after a time limit of non-use.

A tracking ticket 3 may be initially issued to the user (patron) at a register desk or self-register desk. Such a register desk may comprise a ticket printer and a data connection to the server 1 and database 11.

While the present invention has been described in terms of various examples described in the drawings and the written specification, it can be appreciated that variations in the invention are contemplated herein. The full scope of the present invention is particularly described in the following claims. Also, where the term and/or is used herein, it is meant to have the broadest interpretation and scope of the stated possibilities.

What is claimed is:

1. A method of retrofitting an existing gaining machine to enable tracking of gaining activity of a user, comprising:

providing a gaining machine including a cash ticket reader, a cash ticket printer and a computer with software, the software being programmed to enable game play, and to enable the gaining machine to read and print cash tickets;

retro-fitting-the software of the gaining machine and the peripheral devices to further enable the cash ticket reader and cash ticket printer to additionally read and print both tracking tickets and cash tickets using the same device; and the tracking tickets and cash tickets are different from one another;

printing a first or second tracking ticket with the ticket printer, the first or second tracking ticket including a code representative of the user account number;

wherein upon initiating play of the gaining machine, the player inserts a first tracking ticket to read the account information prior to inserting a first cash ticket to read the cash value into the gaining machine;

wherein after the conclusion of the play of the gaining machine, printing a second tracking ticket which includes erasing the first tracking ticket by applying ultraviolet light and re-printing to yield the second tracking ticket.

2. The method as set forth in claim 1 further comprising:

providing a server with a database, the server being connected in communication with the gaining machine;

assigning an account number to the user and storing the account number in the database.

3. The method as set forth in claim 2 further comprising:

providing a ticket to the ticket reader and determining whether the ticket provided to the ticket reader is a tracking ticket or a cash ticket.

4. The method as set forth in claim 3, wherein when the step of determining results in determining that the ticket provided to the ticket reader is a tracking ticket, the method further comprises:

reading the first or second tracking ticket; and using the first or second tracking ticket to provide a data packet to the server.

5. The method as set forth in claim 4, wherein the data packet includes a code representing the user account number.

6. The method as set forth in claim 5, wherein the data packet includes further gaining information selected from the group consisting of: an identification number of the gaining machine, a time stamp, and game results.

7. The method as set forth in claim 6, further comprising:

creating a record of the data packet on the server.

8. The method as set forth in claim 7, further comprising:

communicating at least a portion of the record from the server to the gaining machine.

9. The method as set forth in claim 8, further comprising:

enabling variations in game play based on the record.

10. The method according to claim 9, wherein the account number is invalidated after a predefined time limit.

11. The method as set forth in claim 10, further comprising:

reading a first cash ticket having cash information;

reading a first tracking ticket;

commencing game play and yielding game play results;

amending the cash information according to the game play results; and printing a second cash ticket.

12. The method as set forth in claim 11, further comprising:

tracking the game play results.

13. The method as set forth in claim 9, wherein enabling variations of game play includes offering a bonus game.

14. The method as set forth in claim 13, wherein the tracking ticket records threshold values, the step of offering a bonus game results when at least one threshold value is met.

15. The method as set forth in claim 14, wherein the threshold value is chosen from the group consisting of: number of previous games played, and amount of previous game play time for the user.

16. The method as set forth in claim 15 further comprising: printing a code corresponding to the account number on the first or second tracking ticket.

17. The method as set forth in claim 16, wherein the account number is encrypted.

18. A gaining machine system that enables tracking of gaining activity of a user, comprising:

a server;

a plurality of gaining machines in communication via a computer network with the server;

each gaining machine includes a gaining processor, software, a display and a cash-out-button;

each gaining machine including a cash ticket reader, a cash ticket printer and a computer with software, the software being programmed to enable game play, and to enable the gaining machine to read and print cash tickets;

the software being retro-fitted on the gaining machines and peripheral devices to further enable each cash ticket reader and cash ticket printer to read and print tracking tickets using the same device; and the cash tickets are different from the tracking ticket;

printing a first or second tracking ticket with the ticket printer, the first or second tracking ticket including a code representative of the user account number;

wherein upon initiating play of the gaining machine, the player inserts the first or second tracking ticket to read the account information prior to inserting the cash ticket to read the cash value into the gaining machine;

wherein after the conclusion of the play of the gaining machine, printing a second tracking ticket which includes erasing the first tracking ticket by applying ultraviolet light and re-printing to yield the second tracking ticket.

19. The system as set forth in claim 18, wherein the cash tickets include a cash value.

* * * * *